United States Patent [19]

McHale

[11] 4,283,270

[45] Aug. 11, 1981

[54] PROCESS FOR REMOVING SULFUR FROM PETROLEUM OILS

[75] Inventor: William D. McHale, Swedesboro, N.J.

[73] Assignee: Mobil Oil Corporation, Fairfax, Va.

[21] Appl. No.: 163,008

[22] Filed: Jun. 25, 1980

[51] Int. Cl.[3] ..... C10G 7/00; C10G 45/00

[52] U.S. Cl. ..... 208/50; 208/61; 208/89; 208/93; 208/144; 208/211

[58] Field of Search ..... 208/50, 61, 89, 92, 208/93, 144, 211, 216 PP, 251 H, 254 H

[56] References Cited

U.S. PATENT DOCUMENTS

| | | | |
|---|---|---|---|
| 3,475,327 | 10/1969 | Eng et al. | 208/211 |
| 3,481,996 | 12/1969 | Kirk, Jr. | 208/93 |
| 3,551,326 | 12/1970 | Egan | 208/93 |
| 3,663,427 | 5/1972 | Thomas et al. | 208/93 |
| 3,671,419 | 6/1972 | Ireland et al. | 208/93 |
| 3,767,564 | 10/1973 | Youngblood et al. | 208/93 |
| 3,827,970 | 8/1974 | Whitlew et al. | 208/93 |
| 4,062,762 | 12/1977 | Howard | 208/211 |
| 4,092,238 | 5/1978 | Iowa | 208/93 |

FOREIGN PATENT DOCUMENTS

| | | | |
|---|---|---|---|
| 891475 | 1/1972 | Canada | 208/211 |

*Primary Examiner*—O. R. Vertiz
*Assistant Examiner*—Gary P. Straub
*Attorney, Agent, or Firm*—Charles A. Huggett; Michael G. Gilman; Stanislaus Aksman

[57] ABSTRACT

The present invention is directed to a process for desulfurizing petroleum oils and for improving the performance of known catalytic hydrodesulfurization processes. In accordance with the process, a narrow boiling fraction of a typical hydrodesulfurization feedstock is selectively removed prior to the introduction of said feedstock into the hydrodesulfurization unit. Feedstocks include gas oils, residual oils or other fractions which contain sulfur in the form of sulfides, disulfides and a part of a substituted ring such as thiophene, benzothiophene and dibenzothiophene. The invention embodies the discovery that certain intermediate sulfur compounds are the most refractory or difficult to remove.

10 Claims, 4 Drawing Figures

PROCESS FOR REMOVING SULFUR FROM PETROLEUM OILS

BACKGROUND OF THE INVENTION

1. Field of the Invention

The present invention relates to the desulfurization of petroleum oils and, more particularly, to the hydrodesulfurization of petroleum oil fractions having a significant sulfur content.

2. Description of the Prior Art

As known in the art, the presence of sulfur in petroleum oils and/or products thereof is highly objectionable, with this problem becoming particularly difficult due to the use of crude oils having an ever-increasing sulfur content. In general, sulfur occurs in petroleum oils as mercaptans, sulfides, disulfides, and as part of a substituted ring, of which thiophene, benzothiophene and dibenzothiophene are prototypes. Mercaptans are usually present in lower boiling fractions, i.e., naphtha, kerosene and the like. While numerous processes for removing sulfur from these lower boiling fractions have been proposed, see e.g., U.S. Pat. No. 4,062,762, to a large extent sulfur removal from the higher boiling fractions have proved to be a more difficult operation.

As to be discussed in more detail hereafter, sulfur is present in the higher boiling oil fractions as sulfides, disulfides and as part of the aforesaid ring compounds such as thiophene or benzothiophene with the removal of these compounds being not only difficult but also limiting the use of such heavy fractions as charged stocks for many operations such as cracking, hydrocracking, etc.

In this regard, in the past and perhaps to a limited extent under some present operating techniques, high molecular weight petroleum oil fractions have been processed in a coker to remove the sulfur as well as metal contaminants.

In more recent years, it has been proposed to remove sulfur from heavy oil fractions by catalytic hydrodesulfurization processes. Such hydrodesulfurization techniques are now well known in the petroleum industry with specific examples of some being disclosed, e.g., in U.S. Pat. Nos. 3,440,164; 3,464,915; 3,666,696; 4,006,076; 4,054,508; 4,089,774 and 4,126,538. To a considerable extent such known hydroprocessing technology involves the use of certain catalytic compositions and/or somewhat involved processing steps wherein the charge stock is initially separated into two or more fractions, with each fraction then being subjected to a separate desulfurizing steps. The individual products are then typically recombined.

While such known desulfurizing processes are effective for their intended function, they suffer from several disadvantages as, for example, a limit as to sulfur removal for a given catalyst, high operating cost due to involved processing steps and the like. The present invention is directed to an improvement over such known hydrosulfurization techniques.

SUMMARY OF THE INVENTION

In summary, the present invention relates to the hydrodesulfurization of petroleum oils and more particularly to a novel process for significantly increasing the performance or effectiveness of known catalytic hydrodesulfurization procedures. In its broadest aspect, the present invention embodies the concept and is based on the discovery that the severity required for desulfurization is maximum for certain intermediate sulfur complexes and that the latter are contained within a narrow boiling fraction of the hydrodesulfurization charge stock. The latter is in direct contrast to the teachings of the prior art which considered the most refractory (i.e., the hardest to remove) sulfur compounds to be those having the highest boiling points.

In accordance with the process of the invention, and again broadly speaking for the moment, a narrow boiling fraction of the CHD (catalytic hydrodesulfurization) feedstock centered at about 650° to 700° F., and which contains a major portion of the most refractory intermediate sulfur compounds, is selectively removed (as by distillation) prior to the introduction of the feedstock into the hydrodesulfurization unit. The treated feedstock, from which the 650°-700° F. fraction has been removed, is then charged into the desulfurization reactor wherein it is processed in accordance with known hydrotreating techniques. In this manner, gas oils, heavy petroleum fractions, and the like may be converted into premium products with relatively minor process modifications to existing refinery operations.

It is accordingly a general object of the present invention to provide an improved hydrodesulfurization process.

Another and more particular object is to provide a process wherein hydrocarbon fractions, such as gas oils, having a significant sulfur content may be desulfurized to produce suitable cracking, hydrocracking and other refining feedstocks.

Yet another object is to provide a process for selectively removing the most refractory sulfur contaminants from hydrodesulfurization feedstocks.

Yet another object is to provide an improved hydrodesulfurization process wherein relatively low grade feedstock fractions are converted into premium products.

A still further object is to provide a novel process wherein the sulfur content of gas oils may be significantly reduced with only minor modifications to existing refinery unit operations.

The manner in which the foregoing and other objects are achieved in accordance with the present invention will be better understood in view of the following detailed description and accompanying drawings, which form a part of this specification, and wherein.

DESCRIPTION OF PREFERRED EMBODIMENT(S)

Figure 1:
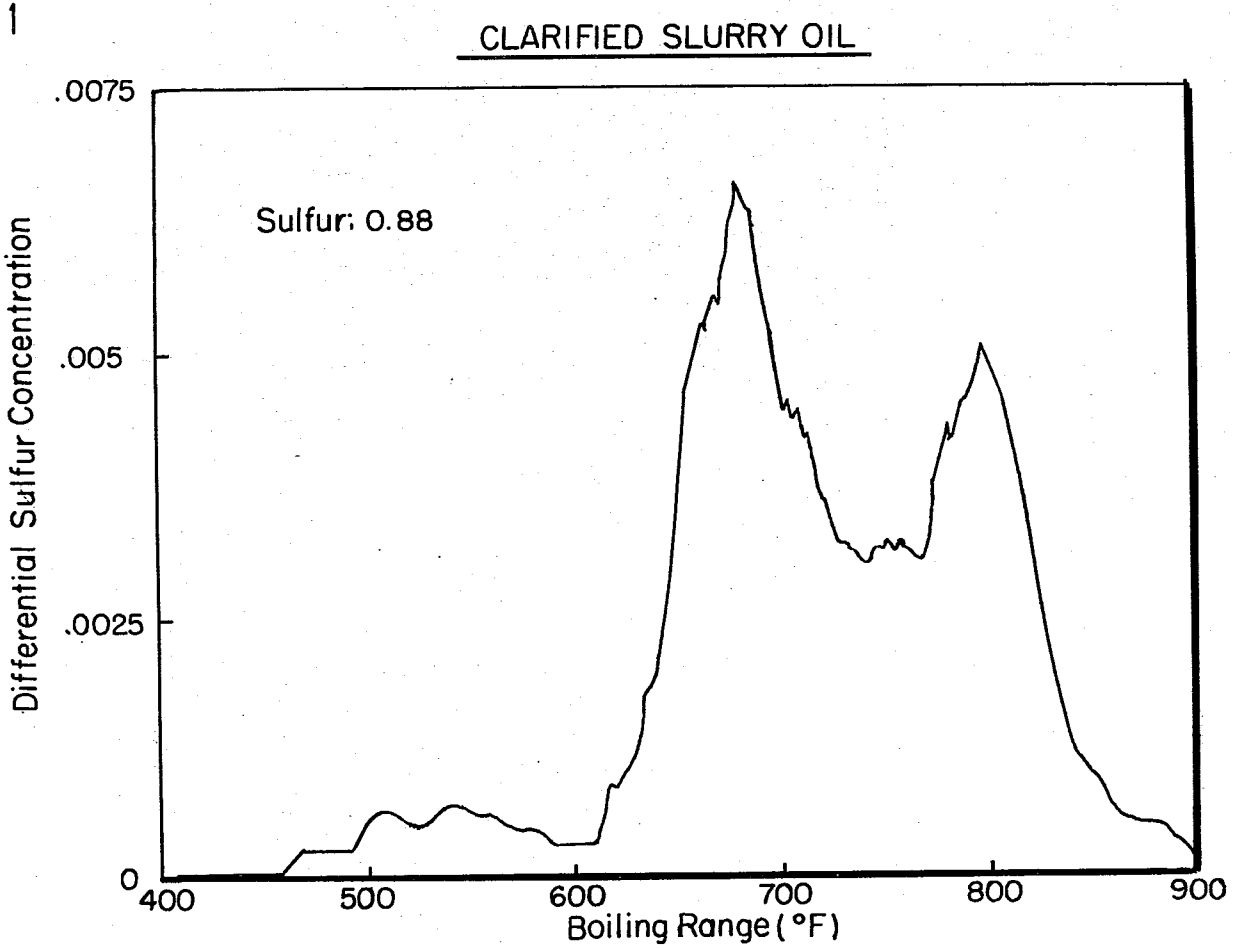
FIG. 1 is a curve showing differential sulfur concentration as a function of boiling range (°F.) for a clarified slurry oil.

As briefly noted above, the instant invention relates to a process for desulfurizing a hydrocarbon oil which, and again broadly speaking for the moment, is based on the discovery that the most refractory of the sulfur compounds are certain intermediate sulfur compounds or homologs thereof and that the selective removal of such materials prior to the hydrodesulfurization of the feedstock itself produces superior results. In accordance with the instant process, a hydrocarbon oil, preferrably boiling in the range of about 350° to 1000° F., is first fractionated, as by distillation, with a narrow boiling fraction thereof and lying in the range of about 650° to 700° F. then being selectively removed. Thereafter the lower and higher boiling fractions formed by said fractionation and from which said cut has been removed, are recombined or blended with this feedstock then being treated in accordance with known catalytic hydrodesulfurization techniques.

In this regard, hydrodesulfurization process are now well known in the refinery art, with such techniques involving contacting the hydrocarbon feed or charge stock with free hydrogen and a hydrogenation catalyst in a reaction zone maintained under hydrodesulfurization reaction or operating conditions. This is typically affected by flowing the oil and hydrogen concurrently upward or downwards (or counter-currently) through the reaction zone containing the catalyst, the latter preferrably comprising a fixed bed of catalyst particles, it being understood, or course, that other forms, i.e. fluidized catalyst particles, slurried particles, etc. may be employed. Typical operating conditions include passing the oil and hydrogen concurrently downwards through one or more fixed beds of catalyst particles while maintaining the reaction zone at a pressure in the range of about 100 to 4000 p.s.i.g., a temperature in the range of about 600° to 900° F. and at a space velocity (flow rate of oil relative to catalyst) of about 0.1 to 10 LHSV. See U.S. Pat. Nos. 4,082,695 and 4,089,774. When higher sulfur removal is desired, desulfurization is carried out under increased operating conditions including a hydrogen pressure of about 2000 to 3000 p.s.i.g., temperatures in the range of from between about 725° to 850° F. and space velocities of from between about 0.1 to 5 LHSV.

Particularly advantageous or preferred catalyst that may be employed in the hydrodesulfurization process are catalysts comprising a hydrogenating component composited with a refractory base. The hydrogenating component may be any material or combination thereof that is effective to hydrogenate and desulfurize a chargestock under the reaction conditions utilized. Particularly advantageous hydrogenating components include metals selected from Group VI and Group VIII of the Periodic Table with a specific example of this embodiment comprising molybdenum and at least one member of the iron group metals. Catalyst containing from between about 2 to 10% by weight cobalt and about 5 to 20% by weight molybdenum have been found to be particularly advantageous. However, as known in the art other combinations such as cobalt and molybdenum, nickel, and tungsten may be employed. Particularly advantageous refractory base materials, with which the hydrogenating component is composited, comprise alumina, silico-alumino, silica magnesa-type compositions, and the like. Preferred composities refractory materials comprise alumina having at least a portion thereof in the delta and/or theta phase. See U.S. Pat. Nos. 4,054,508 and 4,082,695 which are deemed to be incorporated herein by reference.

Turning now to further details of the invention, the feedstock that may be treated in accordance with the instant process may comprise residual petroleum oil fractions as produced by atmospheric or vacuum distillation and containing those fractions boiling above about 350° F. In a preferred and particularly advantageous embodiment of the invention, however, the feedstock comprises a gas oil boiling in the range of from about 350° to 1000° F. As known in the art, gas oils are typically produced by subjecting residual or bottom fractions of crude oil to vacuum distillation at a temperature in the range of from about 600°–800° F. to produce the lighter gas oil fraction boiling in the range of 350° to 1000° F. and a bottom fraction boiling above 1000° F. However, and as will be readily apparent by those skilled in the art, the precise source of a given feedstock will be dictated by the overall design or operation of a given refinery. The feedstock to be treated in accordance with the invention will, however, contain the highly refractory sulfur compounds.

In this regard, sulfur components concentrated in the aforesaid higher boiling fractions or feedstocks are for the most part present as sulfides, disulfides and as part of a ring compound such as thiophene, benzothiophene, dibenzothiophene and/or four (4) ring aromatic sulfur compounds, i.e. benzonaphthothiophene or phenanthrothiophene. In research leading to the instant invention, it was discovered from a detailed sulfur gas chromatographic investigation that the most refractory of these sulfur compounds are those grouped within an intermediate and a relatively narrow boiling range of the feedstock with the severity required for desulfurization of this cut or intermediate portion being maximum. This discovery was indeed significant from the standpoint that petroleum refineries are now processing petroleum oils having ever-increasing sulfur contents, this fact placing a limit on the maximum reduction of sulfur via known hydrodesulfurization techniques.

At this point it may be noted that previous attempts to model the desulfurization process utilized data on sulfur-containing compounds generated from a low resolution mass spectrometric method for type analysis. While the mass spectrometric method yields valuable data for hydrocarbon types, it does not possess the accuracy needed for sulfur analysis at the levels at which sulfur is presented in CHD products. Of the methods investigated to provide data on sulfur-containing compounds, a specific sulfur detector in conjunction with a gas chromatograph yield the best means of acquiring the necessary data.

Figure 2:
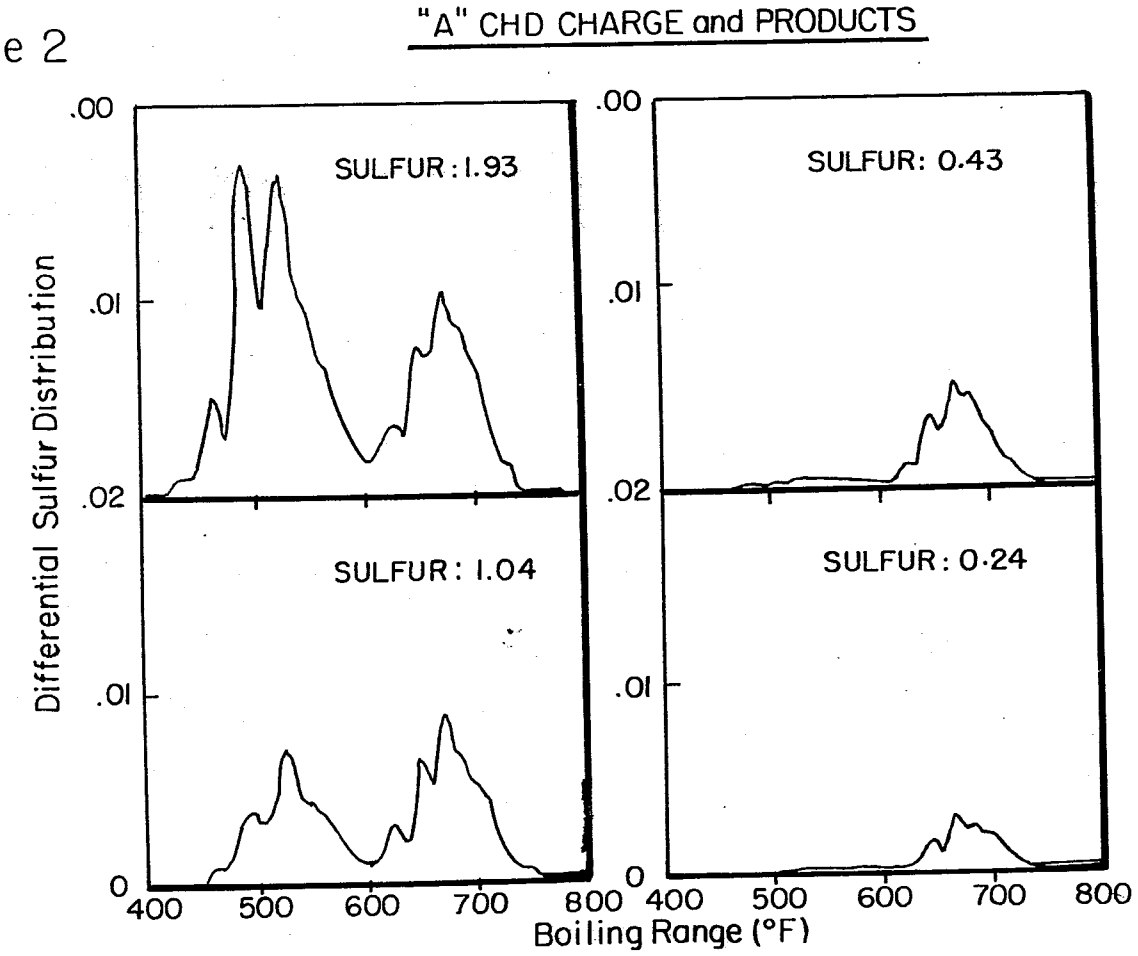
FIG. 2 is a series of four curves showing differential sulfur distribution as a function of boiling range (°F.) for a given catalytic hydrodesulfurization charge stock.
Figure 3:
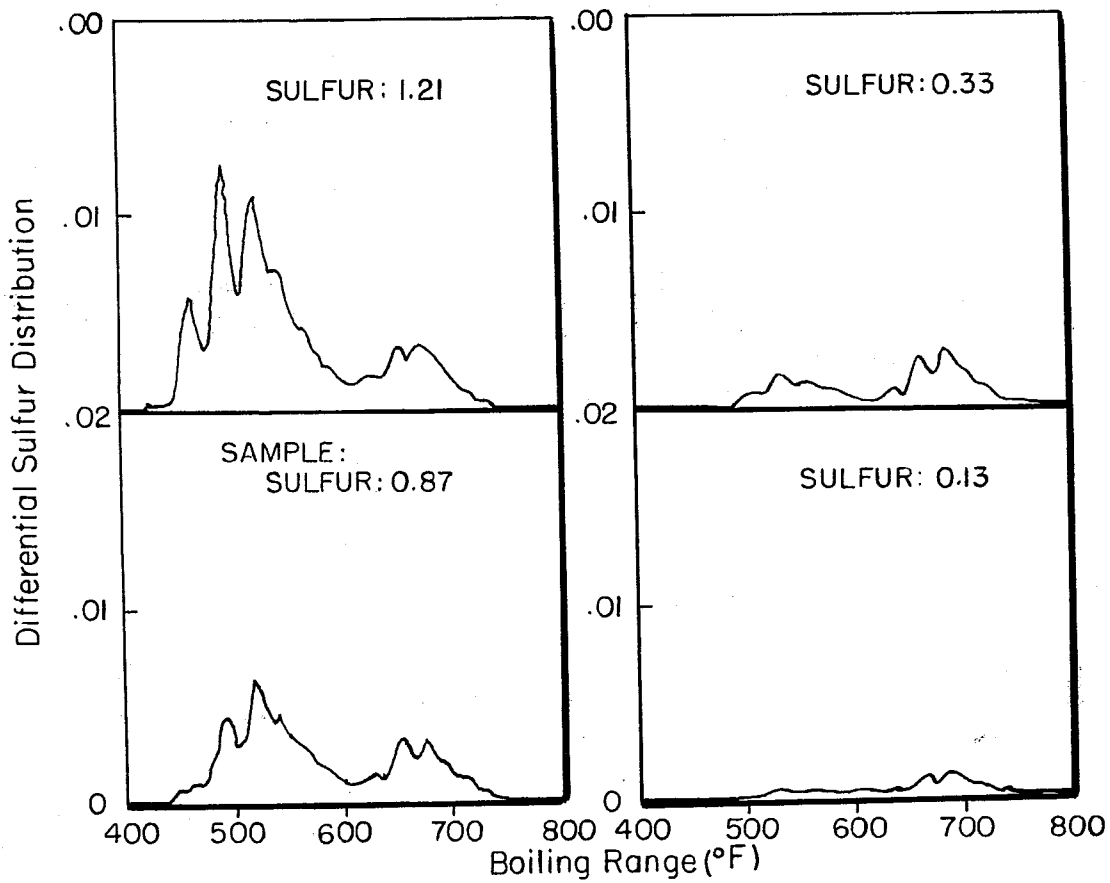
FIG. 3 is a series of four curves showing differential sulfur concentration as a function of boiling range (°F.) for a given catalytic hydrodesulfurization charge stock.
Figure 4:
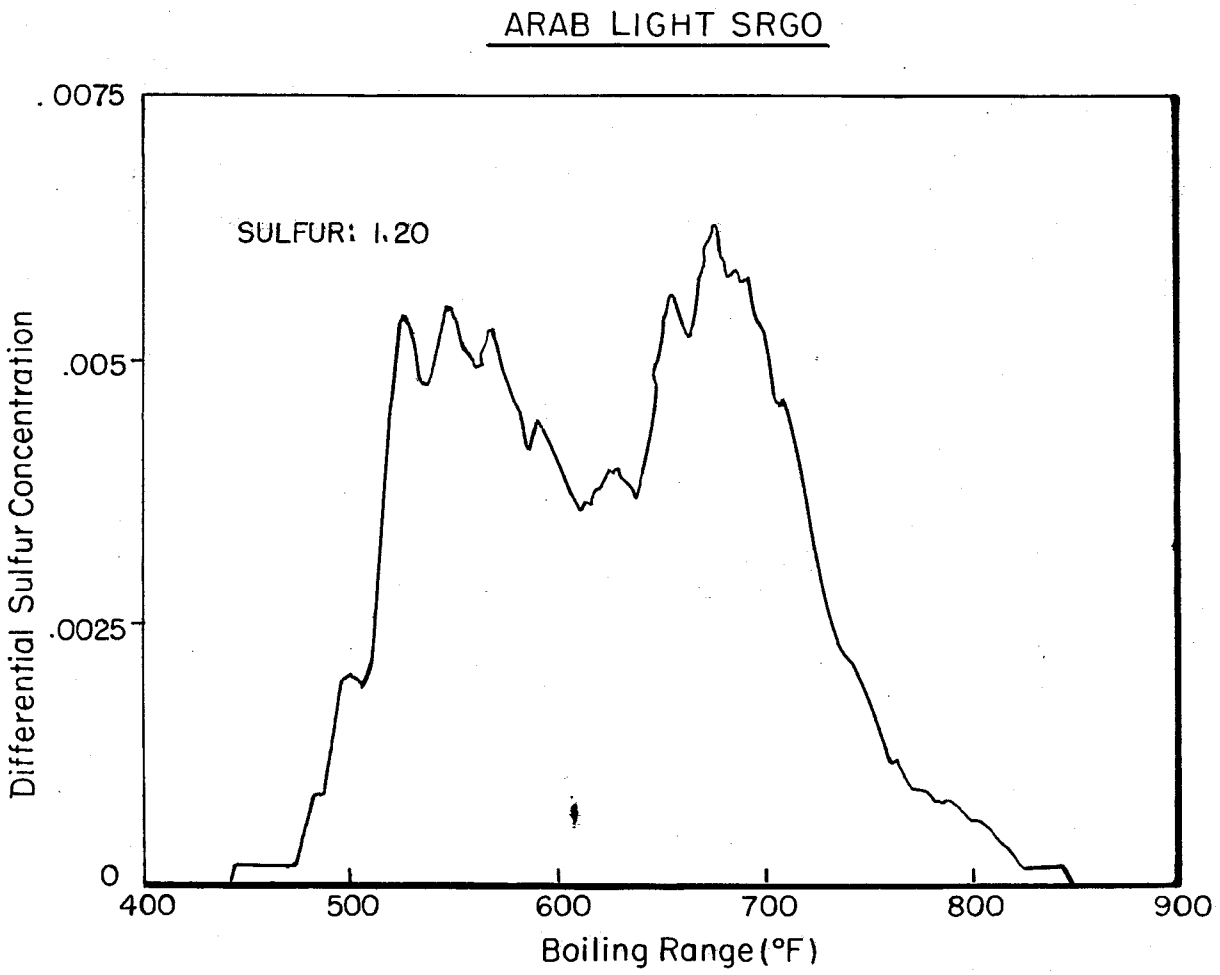
FIG. 4 is a curve showing differential sulfur concentration as a function of boiling range (°F.) for an Arab Light SRGO.

With reference to the drawings the representative distributions of sulfur compounds are illustrated in FIGS. 1 through 4 for clarified slurry oil, CHD charge stocks and desulfurized products (FIGS. 2 and 3) and straight run gas oil, respectively. FIGS. 1–4 are sulfur response versus boiling point (retention time). The boiling points can be calculated from retention times by knowing the boiling points and retention times of standard sulfur containing compounds. As shown, the sulfur found in the feedstocks are distributed primarily in aromatic molecules. The peaks are comprised predominately of various homologs of benzothiophens, dibenzothiophens, and four-membered ring systems. FIG. 1 is the sulfur distribution of clarified slurry oil. The sulfur level is 0.96% wt and is distributed principally between homologs of dibenzothiophene and four-membered aromatic rings containing sulfur. The sulfur in the "A" CHD blend is shown in FIG. 2 with the products desulfurized to different levels. The sulfur level in the this charge is 1.98% wt. As the process conditions are increased in severity with a corresponding decrease in product sulfur concentration, the distribution of sulfur in the products indicate that desulfurization proceeds, by first approximation, from the lower boiling aromatic thiophenic sulfur to the higher boiling types. The rate of desulfurization appears to minimize approximately between C-2 and C-3 dibenzothiophens and then increase for higher homologs and ring systems. This minimum apparently occurs because of a statistical concentration of resistant isomers and the tendency of larger ring systems to more readily hydrogenate. FIG. 3 shows a corresponding CHD charge stock "B" with products thereof for comparison.

When comparing the CHD products with their charge stock, FIGS. 2 and 3, it is apparent that the desulfurization proceeds by order of boiling point up to and through the dibenzothiophenes homologs. This is the case when the majority of sulfur is in aromatic molecules. The exceptions to the generalization are when sulfides and thiols of comparable boiling point are present and when the sulfur containing ring system is larger than dibenzothiophene. After severe desulfurization, only a few isomers of the homologous series of dibenzothiophene or four-membered rings persist.

As a further example of the present invention, a 350°-1000° F. vacuum oil, obtained by the vacuum distillation of the atmospheric residua of a high sulfur content crude oil was subjected to catalytic hydrodesulfurization employing the catalyst composition disclosed in U.S. Pat. No. 4,082,695. The operating conditions for this run are as follows: a hydrogen pressure of 2000 p.s.i.g., a space velocity of 0.75 LHSV; and a temperature of 725° F. The above procedure was then repeated except that the feedstock, prior to being subjected to the catalytic hydrodesulfurization, was fractionally distilled into a lower boiling fraction (boiling below 700° F.) and a higher boiling fraction (above 700° F.). A narrow boiling distillate fraction centered at 675° F. (650°-750° F.) was then selectively removed from the lower boiling distillate. The fractions boiling both lower and higher than the cut at 675° F. were recombined and formed the feedstock for the catalytic hydrodesulfurization treatment. The results of these tests are shown in Table 1 which illustrate that the removal of the narrow boiling distillate fraction centered at 675° F. in accordance with the present invention, substantially increased the desulfurization of the feedstock.

TABLE 1

| | (Prior Art) | |
|---|---|---|
| Run No. | 1 | 2 |
| Desulfurization, weight percent | 85% | 95% |

The invention will be further defined by the following claims which are intended to cover all full equivalents.

What is claimed is:

1. A process for desulfurizing a hydrocarbon oil containing sulfur components and having a boiling range of: about 350° to 1000° F., said process comprising the steps of fractionating said hydrocarbon oil to selectively remove a portion of said hydrocarbon boiling in the range of from about 650° to 700° F.; recombining the fractions of said oil formed by said fractionation and from which said 650° to 700° F. fraction has been removed, and introducing said recombined hydrocarbon oil and hydrogen into a reaction zone containing a hydrogenation catalyst and maintaining said reaction zone under hydrodesulfurization conditions including a hydrogen pressure of up to 3000 p.s.i.g. and a temperature of about 600° to about 900° F.

2. The process in accordance with claim 1 wherein said catalyst comprises the oxides or sulfides of a Group VI or Group VIII metal, or mixtures thereof, on a porous support.

3. The process in accordance with claim 2 wherein said catalyst comprises about 2 to 10% by weight cobalt and from about 5 to 20% by weight molybdenum.

4. The process in accordance with claim 1 wherein said hydrocarbon is gas oil.

5. The process in accordance with claim 1 and further including the step of cracking said oil following said desulfurization, said cracking being carried out under the following conditions: 800° to 1500° F. temperature, 1 to 5 atmospheres pressure and a space velocity of about 1 to 10 LHSV.

6. The process in accordance with claim 1 and further including the step of hydrocracking said oil following said desulfurization, said hydrocracking being carried out under the following conditions: 400° to 1000° F. temperature and 100 to 3500 p.s.i.g. pressure.

7. The process in accordance with claim 1 and further including the step of coking said oil following said desulfurization, said coking being carried out under the following conditions: 800° to 1100° F. temperature and 1 to 10 atmospheres pressure.

8. The process in accordance with claim 1 wherein said hydrocarbon oil is a residual oil.

9. The process in accordance with claim 1 wherein said hydrocarbon oil is a gas oil produced by the vacuum distillation of a residual oil fraction at a temperature of about 600° to 800° F.

10. In a process for catalytically hydrodesulfurizing a hydrocarbon oil wherein hydrogen and said hydrocarbon oil are introduced into a reaction zone containing a hydrogenation catalyst and maintained under desulfurizing conditions, the improvement comprising selectively removing a narrow boiling distillate fraction ranging from about 650° to 700° F. from said hydrocarbon oil prior to its admixture with said hydrogen and introduction into said reaction zone.

* * * * *